US008552827B2

(12) United States Patent
Kudo et al.

(10) Patent No.: US 8,552,827 B2
(45) Date of Patent: Oct. 8, 2013

(54) COIL COMPONENT

(75) Inventors: Yoshiki Kudo, Tokyo (JP); Fumihito Meguro, Tokyo (JP); Tsuyoshi Sato, Tokyo (JP); Takanobu Rokuka, Tokyo (JP); Shinji Okamura, Tokyo (JP)

(73) Assignee: Sumida Corporation, Tokyo (JP)

( * ) Notice: Subject to any disclaimer, the term of this patent is extended or adjusted under 35 U.S.C. 154(b) by 959 days.

(21) Appl. No.: 12/374,045

(22) PCT Filed: Mar. 14, 2007

(86) PCT No.: PCT/JP2007/055100

§ 371 (c)(1),
(2), (4) Date: Feb. 27, 2009

(87) PCT Pub. No.: WO2008/010329

PCT Pub. Date: Jan. 24, 2008

(65) Prior Publication Data

US 2012/0176215 A1 Jul. 12, 2012

(30) Foreign Application Priority Data

Jul. 21, 2006 (JP) ..... P2006-199881

(51) Int. Cl.
*H01F 27/02* (2006.01)
*H01F 27/36* (2006.01)
*H01F 27/30* (2006.01)

(52) U.S. Cl.
USPC ..... 336/84 C; 336/84 R; 336/90; 336/199

(58) Field of Classification Search
USPC ..... 336/84 C, 84 R, 90, 199
See application file for complete search history.

(56) References Cited

U.S. PATENT DOCUMENTS

| | | | | |
|---|---|---|---|---|
| 3,332,049 | A * | 7/1967 | Hisano | 336/83 |
| 6,377,153 | B1 * | 4/2002 | Yamanaka et al. | 336/84 R |
| 2007/0017305 | A1 * | 1/2007 | Abe et al. | 73/862.332 |
| 2007/0132648 | A1 * | 6/2007 | Abe | 343/718 |

FOREIGN PATENT DOCUMENTS

| | | |
|---|---|---|
| JP | B2-63-004687 | 1/1988 |
| JP | A-08-252237 | 10/1996 |
| JP | A-2004-104551 | 4/2004 |
| JP | 3735104 | 1/2006 |
| JP | A-2006-081140 | 3/2006 |

* cited by examiner

*Primary Examiner* — Mohamad Musleh
*Assistant Examiner* — Ronald Hinson
(74) *Attorney, Agent, or Firm* — David R. Stevens; Stevens Law Group

(57) ABSTRACT

The present invention provides a coil component provided with a magnetic core and a coil wound around the magnetic core. The coil component of the present invention is provided with an eddy-current generation member using any one of or any combination of a tape member using a conductive metallic foil, a thin film using a conductive metal material, a ribbon using a conductive metal material, a coated film using a conductive metal material, and a plate member using a conductive metal material. In a coil antenna adopting the coil component of the present invention, it is enabled to adjust the Q value to a desired value without increasing the direct current resistance value.

4 Claims, 12 Drawing Sheets

| No | CONDITION | Q VALUE | RELATIVE TO REFERENCE EXAMPLE |
|---|---|---|---|
| 1 | EXAMINED EXAMPLE 1: SUS TAPE (BOTH SURFACES) | 25.70 | −83% |
| 2 | EXAMINED EXAMPLE 2: Al TAPE (BOTH SURFACES) | 21.29 | −86% |
| 3 | EXAMINED EXAMPLE 3: Al TAPE (ONE SURFACE) | 35.96 | −76% |
| 4 | COMPARATIVE EXAMPLE (RESISTANCE ELEMENT OF 4.7Ω ADDED) | 24.98 | −83% |
| 5 | REFERENCE EXAMPLE | 150.20 | − |

(a)

(b)

(c)

(a)

(b)

(c)

(a)

(b)

(a)

(b)

(c)

(d)

COIL COMPONENT

TECHNICAL FIELD

The present invention relates to a coil component composed of a magnetic core and a wound coil, for example, a coil component favorably adopted in a keyless system transmitting and receiving signal radio waves, a radio-controlled clock, etc.

BACKGROUND ART

Recently, a keyless entry system that is capable of locking and unlocking a door of an automobile, house, etc. without directly touching it, for example by transmitting and receiving signal radio waves, has been put to practical use. To realize the keyless entry system, a coil antenna that can transmit and receive signal radio waves is often used. Also, a coil antenna is often adopted even in a so-called radio-controlled clock that tries to accurately perform time adjustment by means of radio waves. Note that a coil component composed of a magnetic core and a wound coil is favorably adopted in a coil antenna. A system including a coil antenna as a constituent element is also called a coil antenna system.

Here, description is made referring to FIG. 12, with respect to an example of a typical coil antenna used for transmission.

FIG. 12A illustrates an exemplary construction of a conventional coil antenna 100.

FIG. 12B illustrates an example of a magnetic field that is generated when an electric current is applied to the coil.

The coil antenna 100 constitutes a series resonant circuit with a magnetic core 102 formed of a ferritic material, a coil 103 of a conductive wire wound around the magnetic core 102, and a condenser 104 series-connected to the coil 103. The resonance frequency $f_0$ of the coil antenna 100 is determined by this series resonant circuit. Here, a case is assumed that an alternating current with the frequency characteristic corresponding to the resonance frequency $f_0$ is applied to the coil antenna 100. At this time, the coil antenna 100 generates a magnetic flux as illustrated in FIG. 12B to form a magnetic field 105. The coil antenna 100 can transmit a signal wave using the magnetic field 105.

In recent years, the demand for a coil antenna that is capable of transmitting and receiving stable radio signals in a broad frequency range is increasing (in the following description, such demand is also referred to as the demand for making the coil antenna to be broadband). To make a coil antenna to be broadband, it is necessary to apply a strong alternating current of a specific frequency to the coil antenna to generate a strong magnetic field and thereby enable transmission of radio wave signals. Therefore, the range of an allowed characteristic for transmitting and receiving radio wave signals is broadly set. Thereby, even if the characteristics of individual coil antennas vary, they will remain in the allowable range, so that simplification of and freedom in the design concerning manufacture of a coil antenna product can be improved. As a result, it can be tried to decrease the cost of the coil antenna product.

Here, description is made referring to FIG. 13, with respect to band-pass characteristic in the vicinity of the resonance frequency $f_0$ of a coil antenna. In FIG. 13, the vertical axis indicates band-pass characteristic: T of the coil antenna and the horizontal axis indicates a frequency: f of the alternating current applied to the coil antenna.

Generally, to realize a broadband coil antenna, it is effective to "loosen" the band-pass characteristic by adjusting the quality factor: Q value of the coil antenna to a specific value.

Here, to "loosen" the band-pass characteristic means that the change width of the band-pass characteristic in the resonance frequency is made smaller. If the band-pass characteristic is loosened, even when the resonance frequency of the coil antenna is deviated from a required resonance frequency, decrease in the band-pass characteristic of the coil antenna can be kept small.

A solid line 106*a* shown in FIG. 13 represents the band-pass characteristic when the Q value is sufficiently large. The frequency at a peak: $T_1$ of the band-pass characteristic expressed by the solid line 106*a* accords with the resonance frequency: $f_0$. A broken line 106*b* expresses the band-pass characteristic when an alternating current is applied to the coil antenna at a frequency $f_0'$ slightly deviated from the resonance frequency: $f_0$ that should be obtained. A solid line 107*a* represents the band-pass characteristic when the Q value has been adjusted to a specific value. The frequency at a peak: $T_2$ of the band-pass characteristic expressed by the solid line 107*a* accords with the resonance frequency: $f_0$. A broken line 107*b* represents the band-pass characteristic when an alternating current is applied to the coil antenna at a frequency $f_0'$ slightly deviated from the resonance frequency: $f_0$ that should be obtained.

At this time, the difference: $\Delta T_1$ between the Q value: $T_1$ at a peak of the solid line 106*a* and the Q value: $T_1'$ of the solid line 106*a* at the frequency: $f_0'$ slightly deviated from the frequency: $f_0$ is $\Delta T_1=T_1-T_1'$.

Further, the difference: $\Delta T_2$ between the Q value: $T_2$ at a peak of the solid line 107*a* and the Q value: $T_2'$ of the solid line 107*a* at the frequency: $f_0'$ slightly deviated from the frequency: $f_0$ is $\Delta T_2=T_2-T_2'$.

At this time, from FIG. 13, it is indicated as that $\Delta T_1>\Delta T_2$. That is, it can be said that the decrease width of the band-pass characteristic due to the deviation in the resonance frequency is larger when the Q value is higher, than when the Q value is lower.

Here, description is made referring to FIG. 14, with respect to a configuration example that decreases the Q value of the conventional coil antenna 100. Conventionally, to decrease the Q value, the configuration has been widely adopted in which a resistor element 108 is externally connected in series to the condenser 104 provided to the coil antenna 100. Here, the quality factor: Q of the coil antenna can be obtained by the following formula (I):

$$Q=\omega\cdot L/R=2\pi f\cdot L/R \qquad \text{formula (I)}$$

From the formula (1), it is understood that the Q value can be adjusted by changing either or both of the inductance: L of the coil and the resistance: R.

Meanwhile, if the value of the inductance: L is changed by changing the winding number of the coil, etc., the value of the resonance frequency: $f_0$ of the coil antenna also changes, which is inadvisable. Therefore, conventionally, it has been said that it is desirable to adjust the quality factor: Q of the coil antenna by changing the value of the resistance: R.

Patent Document 1 discloses a conventional coil antenna.

Patent Document 1: Publication of Japanese Patent No. 3735104

DISCLOSURE OF THE INVENTION

Meanwhile, if a resistance element is externally connected to a coil antenna to adjust the Q value, the resistance value of a whole coil antenna system including the coil antenna as a constituent element is caused to increase. Here, description is made referring to FIG. 15, with respect to impedance: Z relative to the frequency: f of an alternating current to be applied to a coil antenna.

In FIG. 15, the vertical axis indicates impedance: Z and the horizontal axis indicates frequency: f. The impedance Z: at this time can be obtained by the formula below. Here, a reactance obtained from a coil and a condenser is expressed as X.

$$Z=\sqrt{(R^2+X^2)}$$

$$X=\omega L-1/\omega C$$

When the frequency of the alternating current to be applied to the coil antenna accords with the resonance frequency, the impedance: Z is introduced as follows:

$$X=\omega L-1/\omega C=0$$

$$Z=\sqrt{R^2}=R$$

From this result, it is understood that the impedance Z: takes the smallest value R. Further, from FIG. 15, it is indicated that the impedance: Z takes the smallest value: R at the resonance frequency: $f_0$ of the alternating current.

Accordingly, if an alternating current that accords with the resonance frequency of a coil antenna is applied to the coil antenna, the impedance: Z depends only on the resistance: R component. Therefore, in a configuration in which a resistance element is connected in series to a coil antenna, if a strong magnetic field is generated by applying a large alternating current to the coil antenna, heat generation of the coil antenna, etc. have been notable problems.

The present invention has been made in view of the above-described problems, and the invention aims, to attain making the coil antenna to be broadband, to provide a coil component that is capable of adjusting the Q value to a desired value without increasing the direct current resistance value and transmitting and receiving radio wave signals in more stable manner.

The present invention provides a coil component provided with a magnetic core, a coil wound around the magnetic core, and an eddy-current generation member.

The coil component of the present invention is formed with an eddy-current generation member in the magnetic core, so that an eddy current occurs when an electric current is applied.

According to the present invention, it becomes possible to adjust the Q value to a desired value by utilizing an eddy current occurred in the eddy-current generation member, without increasing the direct current resistance value of a coil antenna system adopting the coil antenna of the present invention.

BEST MODE FOR CARRYING OUT THE INVENTION

Below, a configuration example of a coil antenna according to the first embodiment of the present invention is described with reference to FIG. 1 through FIG. 4. In the present embodiment, description is made with respect to a coil antenna 10 that is adopted in a keyless entry system capable of locking and unlocking without directly touching a door of an automobile, house, etc., by means of transmission and reception of signal radio waves. The coil antenna 10 is mainly installed on the door side. A coil component of the present invention that is constituted of a magnetic core and a wound coil is favorably applied to the coil antenna 10.

Figure 1:
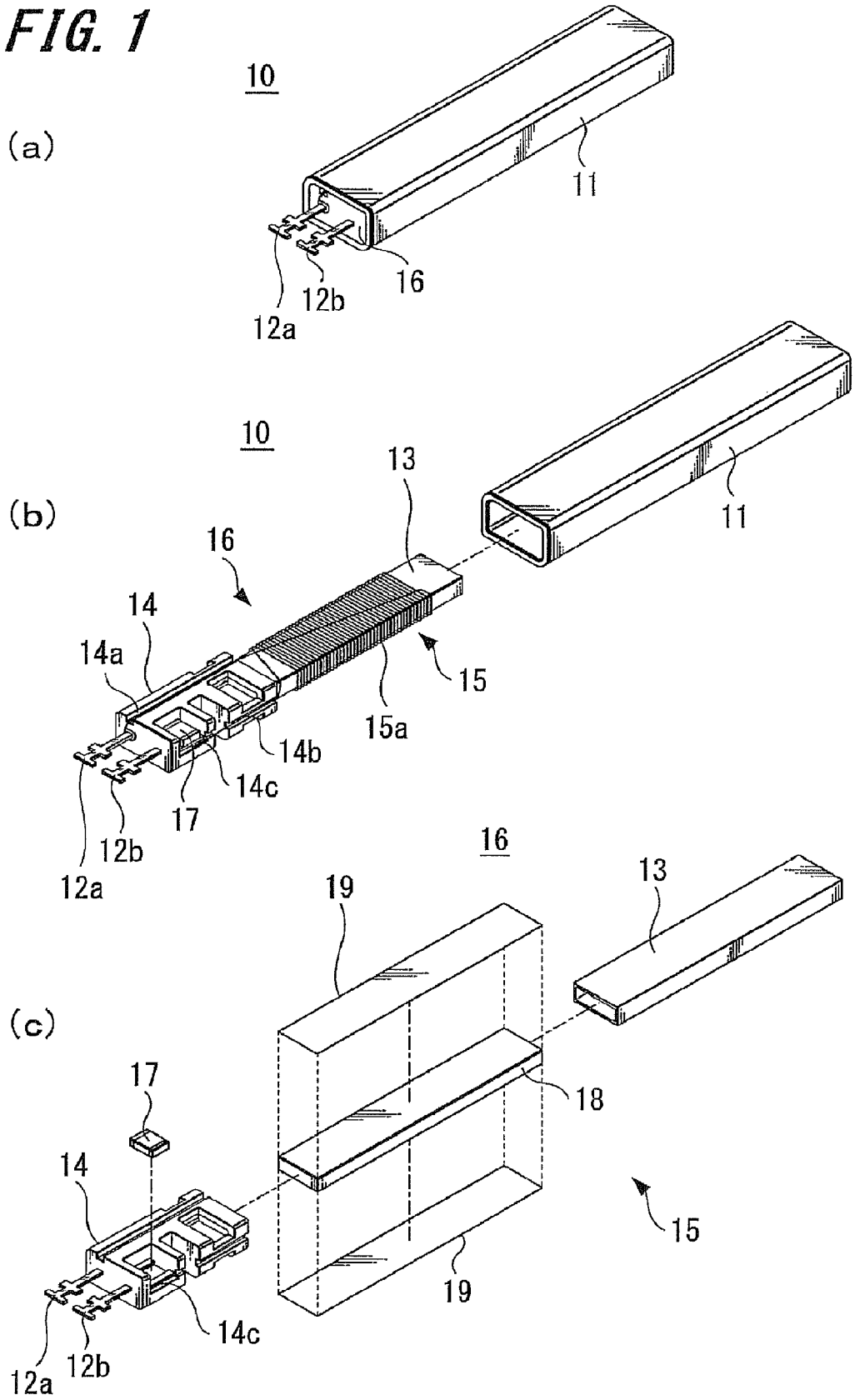
FIG. 1 is a perspective view illustrating a coil antenna in a first embodiment of the present invention.

First, the configuration example of the coil antenna 10 is described with reference to FIG. 1.

FIG. 1A is a perspective view illustrating an exterior configuration example of the coil antenna 10. The coil antenna is formed of a main body 16 in which a coil is formed, harness terminals 12*a*, 12*b* implanted to the main body 16, and an exterior member 11 formed of nonconductive resin and covering the main body 16. The exterior member 11 is formed in a tube shape having an opened-end on one end side and a closed-end on the other end side, and has a function of protecting the coil, etc. that are formed in the main body 16. The harness terminals 12*a*, 12*b* used for connection to external terminals are implanted to one end of the main body 16.

FIG. 1B is a perspective view illustrating an example of a state that the exterior member 11 has been detached from the coil antenna 10. The exterior member 11 is a housing in a rectangular parallelepiped shape, having a cross section in a hollow shape that is substantially the same as the shape of the cross section in the width direction of the main body 16. The main body 16 is provided with a base 14 formed of nonconductive resin, and a coil winding section 15 on which a coil 15*a* is formed through an insulating layer. The coil 15*a* is formed by winding a conductive wire (coil wire) a desired number of times around an insulating layer 13 that is an insulating tube of a rubber family. The insulating layer 13 covers a magnetic core (see FIG. 10 described later) that is a flat plate in the shape of a rod, and provides isolation between the wound conductive wire and the magnetic core 18. Further, the insulating layer 13 provides isolation between the wound conductive wire and an eddy-current generation member 19 (see FIG. 10 described later) formed in the magnetic core 18.

The base 14 is formed with a concave portion for mounting a condenser 17, and this concave portion serves as a condenser mounting section 14*c*. In the base 14, grooves 14*a*, 14*b* that guide the conductive wire not to contact the exterior member 11 are formed. One end of the coil 15*a* is guided along the groove 14*a* and is twined around the harness terminal 12*a*. The other end of the coil 15*a* is guided along the groove 14*b* and is connected to a terminal electrode formed in the condenser mounting section 14*c*. The condenser 17 is mounted in the condenser mounting section 14*c*, and one electrode of the condenser 17 is connected to a terminal electrode of the harness terminal 12*b*. The other terminal electrode of the condenser 17 is connected to the other end of the coil 15*a*. Thus, the condenser 17 and the coil 15*a* are connected in series and thereby a series resonance circuit is constituted.

FIG. 1C is a perspective view illustrating an example of a state that the main body 16 has been disassembled. The magnetic core 18 made of a ferrite material is inserted into the insulating layer 13, which is an insulating tube of a rubber family, and thereby the coil winding section 15 is formed. The magnetic core 18 is in a flat plate shape, and a ferrite of an Mn—Zn family that is superior in the magnetic characteristic such as the magnetic permeability, the maximum saturation magnetic flux density, etc. is used as the material so that a strong magnetic field can be excited. An eddy-current generation member 19 that generates an eddy current on its surface by occurrence of a magnetic field or magnetic flux is formed in each of the upper and lower surfaces of the magnetic core 18. The eddy-current generation member 19 is in a rectangular shape having substantially the same size relative to the upper and lower surfaces of the magnetic core 18. The condenser 17 of multi-layer chip type is mounted in the condenser mounting section 14*c*. An accommodation section not illustrated is formed in the end portion of the base 14 (on the magnetic core 18 side), so that the coil winding section 15 can be accommodated and fixed by adhesion.

By covering the magnetic core 18 and the eddy-current generation member 19 with the insulating layer 13, short-circuiting that could occur between the conductive wire and the eddy-current generation member 19 and/or between the conductive wire and the magnetic core 18 can be suppressed. Also, a trouble such that when winding the conductive wire around the coil winding section 15, the covering film of the conductive wire is peeled off at a corner portion of the magnetic core 18 can be suppressed. Note that the material of the magnetic core 18 is not limited to the ferrite of Mn—Zn family, and a ferrite of Ni—Zn family, a magnetic body of metal family, etc. having a desired magnetic characteristic may be adopted as the material. Further, the magnetic core 18 has been assumed to be a flat plate in the shape of a rod, however, may be in an arbitrary shape depending on the intended use.

Here, description is made with respect to the eddy-current generation member 19 that is adopted in this embodiment. The eddy-current generation member 19 is a member used for changing the Q value of the coil antenna 10 by the generated eddy current. If an electric current is applied to the coil antenna 10, a magnetic field is generated by the coil 15*a*, and an eddy current is generated on the surface of the eddy-current generation member 19. Then, the eddy-current loss increases by the generated eddy current. As a result, due to the eddy-current loss, it becomes possible to change the Q value without increasing the resistance component. In the present embodiment, a metal tape member, i.e., a tape member using a stainless (SUS) foil, is attached to the magnetic core 18 so as to cover substantially the whole surface of the wide surface (upper and lower surfaces) of the magnetic core 18, and thereby the eddy-current generation member 19 is formed.

Favorable examples of the material of the metal tape adopted in the eddy-current generation member 19 are given below. For example, when the coil antenna 10 is used in various environments such as automobiles, etc., it is preferable to adopt materials that have a certain degree of electrical conductivity and that are superior in corrosion resistance, such as stainless (SUS: electrical resistivity $5\text{-}10\times10^{-6}\Omega\cdot\text{cm}$), aluminum (Al: electrical resistivity $2.655\times10^{-6}\ \Omega\cdot\text{cm}$), etc. However, when the coil antenna 10 is used in the environment where the corrosion resistance, etc. are not considered, a metal tape formed of material having low electrical resistivity is used, such as copper (Cu: electrical resistivity $1.678\times10^{-6}\ \Omega\cdot\text{cm}$), silver (Ag: electrical resistivity $1.62\times10^{-6}\ \Omega\cdot\text{cm}$), gold (Au: electrical resistivity $2.2\times10^{-6}\ \Omega\cdot\text{cm}$), etc. If the metal tape is adopted, it is possible to generate a lot of eddy currents, and it becomes possible to efficiently adjust the Q value. Also, it is easy to form the eddy-current generation member 19.

Note that as the eddy-current generation member 19, in addition to using a metal tape on the surface of which a conductive metal foil has been formed, it is also possible to adopt members mentioned below.

(1) A Conductive Metallic Thin Film Formed by a Metal Evaporation Method:

If a conductive metallic thin film is formed with a metal evaporation method, it can be formed as the eddy-current generation member 19 without causing an adhesive layer of a tape to intervene relative to the magnetic core 18. Therefore, it is possible to cause the eddy current to be efficiently generated in the eddy-current generation member 19. Also, by controlling the generation process of an evaporated film, the film thickness of the evaporated film (metallic thin film) can be easily controlled to a desired thickness. Further, it is possible to carry out evaporation processing in a state that a plurality of pieces of the magnetic core 18 that become the evaporation targets have been set out. Consequently, there are effects that mass production is dealt with and metallic thin films that are kept at a specific level of quality can be formed.

(2) A Conductive Metal-Plated Thin Film Formed by a Plate Processing Method:

Also, by forming a conductive metal-plated thin film by means of a plate processing method, the conductive metal-plated thin film can be formed as the eddy-current generation member 19 without causing an adhesive layer of a tape to intervene relative to the magnetic core 18. Therefore, like the above-described conductive metallic thin film formed by the metal evaporation method, it is possible to cause the eddy current to be efficiently generated in the eddy-current generation member 19. Also, there are effects that mass production is dealt with and metallic thin films that are kept at a specific level of quality can be formed. Also, as the plate processing method, electrolytic plating, non-electrolytic plating, etc. can be adopted.

(3) A Conductive Metal Ribbon Formed by a Single Roll Forming Method or Dual Roll Forming Method:

A conductive metal ribbon can be formed as the eddy-current generation member 19 by a single roll forming method or dual roll forming method. When attaching the conductive metal ribbon to the magnetic core 18, it is preferable to use a fixing member such as an adhesive, etc. When this method is used, an effect similar to that in the above-described metal evaporation method is produced in that it is suitable for mass production.

(4) A Coated Film Containing a Conductive Metal Material Formed by Coating:

If a conductive metal-coated film is formed as the eddy-current generation member 19, processing facilities, production processes, etc. are extremely simple and suitable for mass production, so that it is effective in greatly contributing to reduction of the production cost. Also, although the degree of the eddy-current generated by the obtained coated film tends to be inferior compared with the above-described (1) conductive metallic thin film through (3) conductive metal ribbon, it is possible to sufficiently adjust the Q value by controlling the thickness of the coated film, etc.

Figures 2, 3:
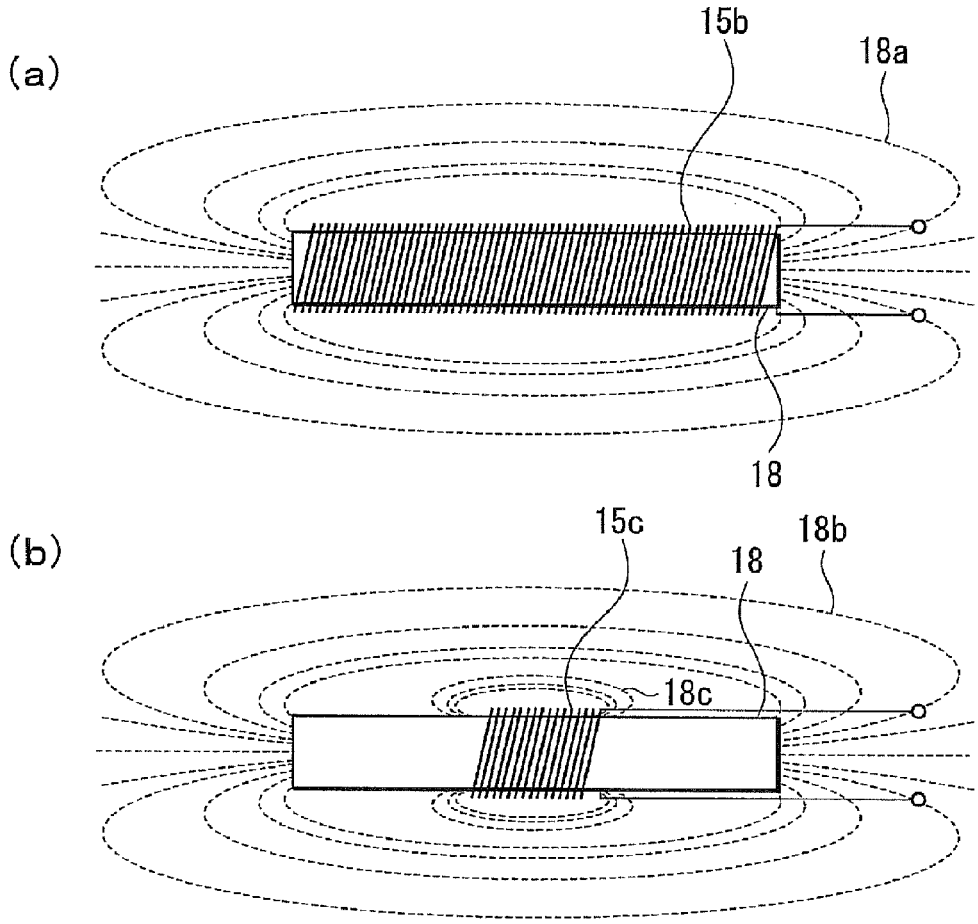
FIG. 2 is an explanatory diagram illustrating examples of the Q value relative to eddy-current generation members in the first embodiment of the present invention.
FIG. 3 is an explanatory diagram illustrating examples of a coil and a magnetic field in the first embodiment of the present invention.

Next, description is made referring to FIG. 2, with respect to the Q value actually measured while changing the material of the eddy-current generation member 19 that is attached to the magnetic core 18. In FIG. 2, actually measured Q values and ratios of the Q values relative to a reference example when a stainless (SUS) tape member or an aluminum (Al) tape member has been adopted as the eddy-current generation member 19 are described. Here, the reference example expresses a band-pass characteristic when the coil antenna 10 in which the eddy-current generation member 19 and a resistance element are not disposed has been actually measured alone.

The detailed conditions of examined examples of respective eddy-current generation members 19 (metal tape members) are as follows.

Examined Example 1

Material of the Tape: Stainless (SUS)

Tape attaching condition: The dimension in the longitudinal direction is substantially the same as that in the longitudinal direction of the magnetic core 18.

Dimension in the width direction is substantially the same as that in the width direction of the magnetic core 18.

Tape attaching position: The tape is attached to each of the wide surfaces of the magnetic core 18.

Examined Example 2

Material of the Tape: Aluminum (Al)

Tape attaching condition: The dimension in the longitudinal direction is substantially the same as that in the longitudinal direction of the magnetic core 18.

Dimension in the width direction is substantially the same as that in the width direction of the magnetic core 18.

Tape attaching position: The tape is attached to each of the wide surfaces of the magnetic core 18.

Examined Example 3

Material of the Tape: Aluminum (Al)

Tape attaching condition: The dimension in the longitudinal direction is substantially the same as that in the longitudinal direction of the magnetic core 18.

Dimension in the width direction is substantially ⅓ of that in the width direction of the magnetic core 18.

Tape attaching position: The tape is attached to one of the wide surfaces of the magnetic core 18.

Comparative Example

A conventional coil antenna in which a resistance element having the resistance value: 4.7Ω is connected in series to the coil antenna 10 is measured as a comparative example and is put in FIG. 2.

Reference Example

The coil antenna 10 in which the eddy-current generation member 19 and a resistance element are not arranged is measured alone as a reference example and its band-pass characteristic is put in FIG. 2.

From FIG. 2, it is understood that relative to the Q value: 150.20 of the Reference Example in which the eddy-current generation member 19 and a resistance element are not disposed in the coil antenna 10, each of the measured Q values of the Examined Examples 1-3 shows the decreasing rate equal to or greater than −70%.

In particular, when compared with the Q value: 24.98 measured in the Comparative Example (the resistance element having the resistance value of 4.7Ω is added to the coil antenna 10), it is understood that the Q value: 25.70 of the SUS tape of the Examined Example 1 is the most approximated result (both show −83% relative to the Reference Example). From this, although the conventional coil antenna in which a resistance element having the resistance value of 4.7Ω has been connected to the coil antenna 10 and the coil antenna in which the eddy-current generation member 19 has been formed are differently formed, they can both adjust the Q value in a similar manner. Also, it is understood that making the coil antenna to be broadband can be easily realized.

Here, description is made with respect to the operation of the eddy-current generation member 19 using the Q value of the SUS tape of the Examined Example 1 and the formula (1): $Q=2\pi f\cdot L/R$. Note that as the electrical characteristic that is necessary when using the formula (1), the coil antenna 10 of the Comparative Example has the inductance value: 190.5 μH and the direct current resistance value: 5.132Ω (breakdown: added resistance element: 4.7Ω and the resistance portion of wires, etc.: 0.432Ω). At this time, the resistance: $R_0$ can be obtained from the formula (1) as follows;

$$24.98=(2\times3.14\times125\text{ kHz}\times190.5\ \mu\text{H})/R_0\Omega+5.132\Omega$$

$$R_0=0.854\Omega$$

Also, the coil antenna 10 of the Examined Example 1 has the inductance value: 191.6 μH and the direct current resistance value: 0.436Ω. At this time, the resistance $R_1$ can be obtained from the formula (1) as follows;

$$25.70=(2\times3.14\times125\text{ kHz}\times191.6\ \mu\text{H})/R_1\Omega+0.436\neq$$

$$R_1=5.416\Omega$$

From the calculation result above, it is indicated that the increasing portion of the resistance: 4.7Ω when a resistance element has been connected for adjusting the Q value and the increasing portion of the resistance: 5.41Ω when the eddy current (loss) generated by the eddy-current generation member has been regarded as the resistance component become approximated values. That is, if an electrical current is applied in a state that the eddy-current generation member 19 (for example, conductive metal tape member) has been attached to the magnetic core 18, the eddy-current loss increases due to the generated eddy current. As a result, the action that the Q value can be changed without increasing the resistance component is obtained.

Next, if the Q value: 25.70 of the Examine Example 1 and the Q value: 21.29 of the Examined Example 2 are compared, the decreasing rate of the Q value of the Al tape member is greater than that of the SUS tape member. It is perceived as that this is due to that while the resistivity of SUS is $5\text{-}10\times10^{-6}\Omega\cdot\text{cm}$, the resistivity of Al is low such as $2.655\times10^{-6}$ Ω·cm, so that as compared with the SUS tape member, the occurrence degree of the eddy current is large.

Also, if the Examined Example 2 and the Examined Example 3 are compared, although respective eddy-current generation members 19 agree with each other in that each uses a tape member using an Al foil, the areas where the tape members are attached are different (in the Examined Example 2, upper and lower surfaces of the magnetic core 18, and in the Examined Example 3, one of the upper and lower surfaces of the magnetic core 18). Consequently, the decreasing rate of the Q value relative to the Reference Example has changed about 10%. As a result, it is understood that the Q value changes as the area or volume of the eddy-current generation member 19 changes. That is, it can be said that it is possible to control the Q value at a high accuracy by controlling the area or volume or the change in the formation position of the eddy-current generation member 19.

As described above, in the coil antenna 10, the eddy-current generation member 19 is formed in a desired place on the magnetic core 18. Consequently, it becomes possible to adjust the Q value to a desired value without increasing the direct current resistance value of the entire coil antenna system. As a result, it can be easily realized to make the coil antenna to be broadband, and a coil antenna that can keep the stable band-pass characteristic in a broadband can be obtained. Also, the eddy-current generation member can be easily formed in the coil antenna 10, so that there is an effect that the Q value can be easily adjusted.

Also, besides attaching a metal tape onto the magnetic core 18, by using various techniques such as a metal evaporation method, a plate processing method, etc., an eddy-current generation member can be formed on a magnetic core. Therefore, it is only necessary to form an appropriate eddy-current generation member depending on the use, and there is an effect that freedom in design increases.

Note that in the above-described first embodiment, the eddy-current generation member 19 (metal tape member, metallic thin film, metal ribbon, etc.) is attached to or formed in each of the wide surfaces, i.e., upper and lower surfaces of the magnetic core 18 so as to cover the entire surface thereof. In this regard, however, depending on the degree that the Q value is adjusted, the shape of the eddy-current generation member may be variously changed.

Here, description is made referring to FIG. 3, with respect to examples of a magnetic field excited depending on the winding method of a coil that is wound around the magnetic core 18.

FIG. 3A illustrates an example that a coil 15*b* is wounded substantially equally to the longitudinal dimension of the magnetic core 18. In this case, if an electric current is applied, a magnetic field 18*a* is generated from both ends of the magnetic core 18.

FIG. 3B illustrates an example that a coil 15*c* is wound around a part of the magnetic core 18. In this case, if an electric current is applied, an electric field 18*b* is generated from both ends of the magnetic core 18. Further, an electric field 18*c* is generated at ends of the coil 15*c*.

Thus, depending on the winding method of a coil that is wound around the magnetic core 18, as illustrated in FIG. 3A and FIG. 3B, the degree of occurrence of a magnetic flux and a magnetic field changes. Accordingly, it is only needed to arbitrarily form an eddy-current generation member in accordance with the winding method of a coil that is wound.

Figure 4:
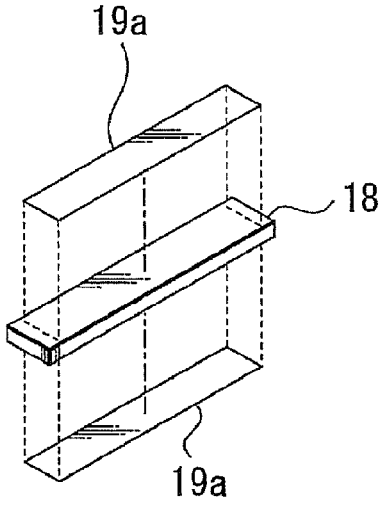
FIG. 4 is a perspective view illustrating examples of an eddy-current generation member formed in a magnetic core in the first embodiment of the present invention.
Figure 4:
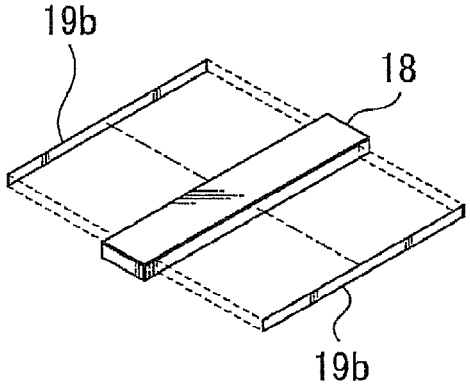
Figure 4:
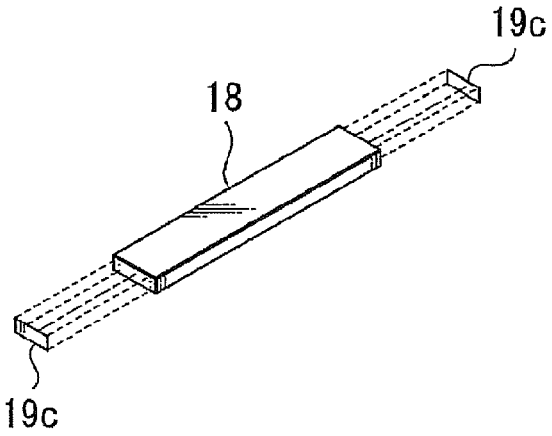

Here, description is made referring to FIG. 4, with respect to examples of the places of the magnetic core 18 where an eddy-current generation member is formed.

FIG. 4A illustrates an example that an eddy-current generation member 19*a* has been formed in each of the upper and lower surfaces of the magnetic core 18. The size of the eddy-current generation member 19*a* is made a little bit smaller relative to the size of the upper surface of the magnetic core 18. Of course, the eddy-current generation member 19*a* may be disposed in only one surface of the upper and lower surfaces correspondingly to a desired Q value adjustment.

FIG. 4B illustrates an example that an eddy-current generation member 19*b* has been formed in each of the side surfaces of the magnetic core 18. The size of the eddy-current generation member 19*b* is made a little bit smaller than the size of the side surface of the magnetic core 18. Of course, the eddy-current generation member 19*b* may be disposed in only one side surface of the both side surfaces correspondingly to a desired Q value adjustment.

Figure 14:
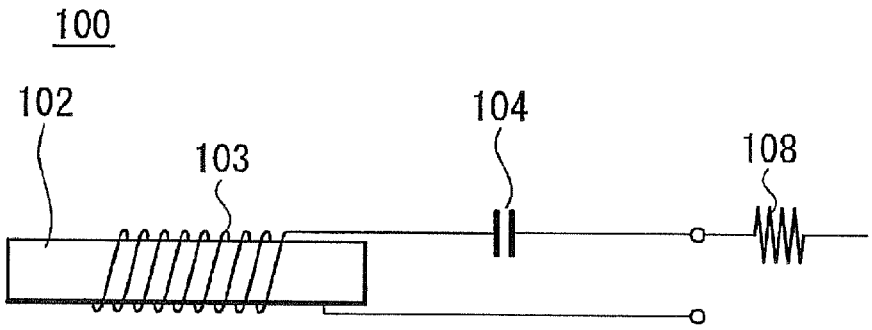
FIG. 14 is a configuration diagram illustrating an example that a resistance element is connected to a conventional coil antenna.
Figure 15:
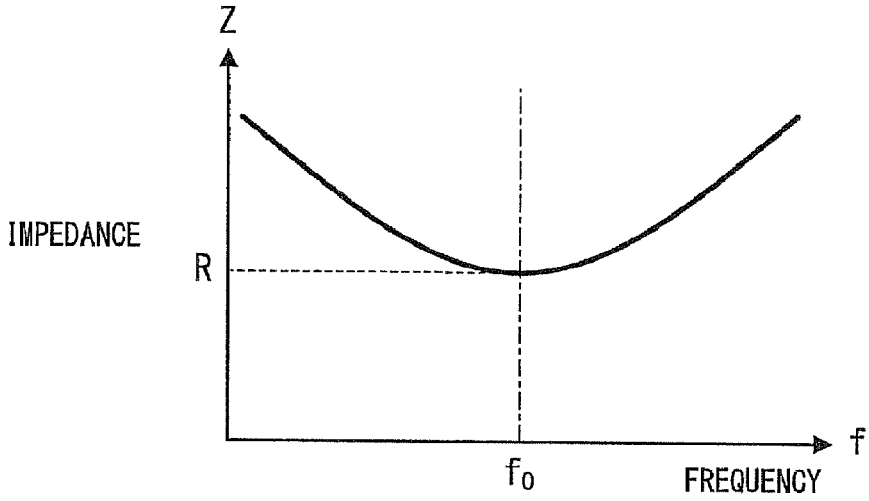
FIG. 15 is an explanatory diagram illustrating an example of impedance of a conventional coil antenna.

FIG. 4C is a diagram illustrating an example that an eddy-current generation member 19*c* has been formed in each of the end surfaces of the magnetic core 18. The size of the eddy-current generation member 19*c* is made a little bit smaller than that of the end surface of the magnetic core 18. Of course, the eddy-current generation member 19*c* may be disposed only in one end surface of the both end surfaces correspondingly to a desired Q value adjustment. If the eddy-current generation member 19*c* is configured as illustrated in FIG. 14C, most of the magnetic flux discharged from and absorbed by the end surfaces and the magnetic field passes the eddy-current generation member 19*c*. Consequently, it is possible to efficiently generate the eddy current, and the adjustment width of the Q value can be enlarged.

As illustrated in FIG. 4A through FIG. 4C, the eddy-current generation member can be formed in any place on the magnetic core 18. Also, the size of the eddy-current generation member can be varied. Thus, because the eddy-current generation member can be formed in a desired place on the magnetic core 18, there is an effect that the Q value can be finely adjusted. Also, because the eddy-current generation member can be easily formed, there is also an effect in cost decrease. It is needless to say that it is possible to finely adjust the Q value by multiply combining the eddy-current generation members illustrated in FIG. 4A through FIG. 4C.

Figure 5:
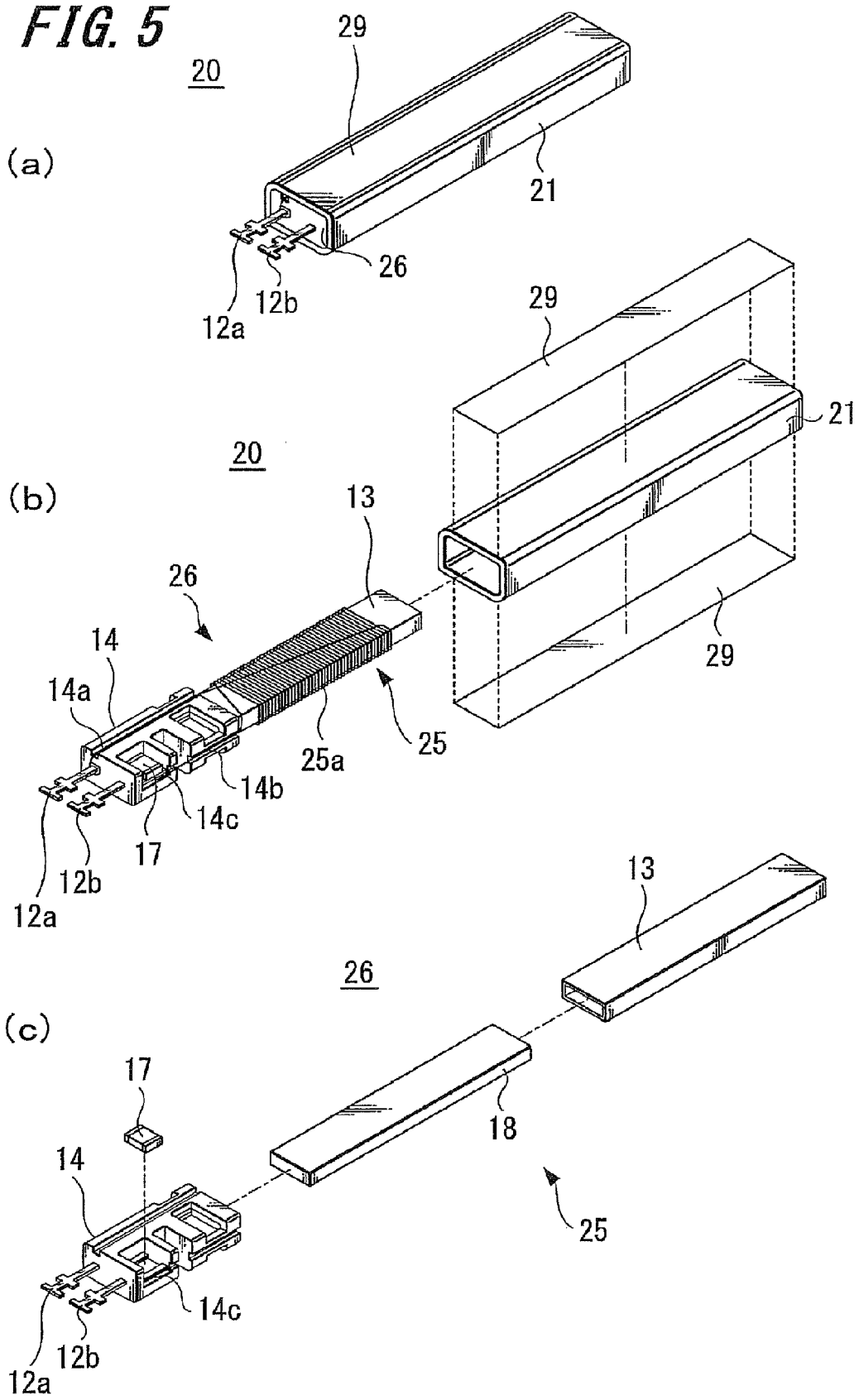
FIG. 5 is a perspective view illustrating a coil antenna in a second embodiment of the present invention.
Figure 6:
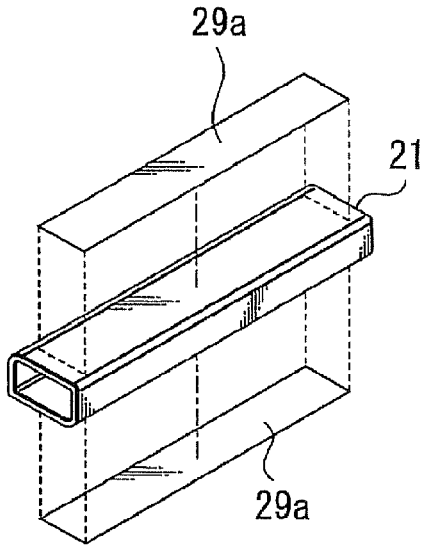
FIG. 6 is a perspective view illustrating examples of an eddy-current generation member formed in an exterior member in the second embodiment of the present invention.
Figure 6:
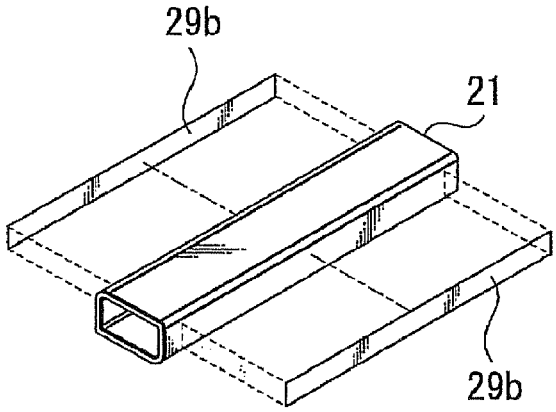
Figure 6:
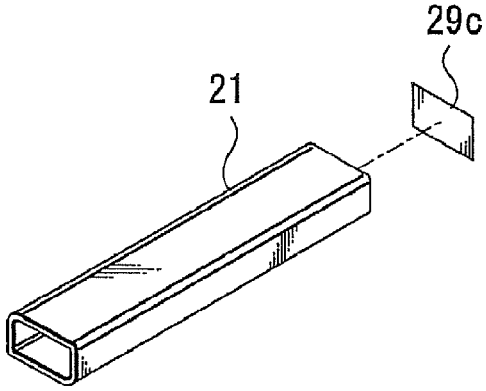

Next, description is made with respect to a coil antenna according to a second embodiment of the present invention, referring to FIG. 5 and FIG. 6. In this embodiment also, description is made as an example applied to a coil antenna 20 which will be adopted in a keyless entry system. Note that the coil component of the present invention that is constituted of a magnetic core and a wound coil is favorably applied to the coil antenna 20. The parts corresponding to those of FIG. 1 in the previously described first embodiment are denoted by the same reference symbols.

First, description is made referring to FIG. 5, with respect to a configuration example of the coil antenna 20.

FIG. 5A is a perspective view of the coil antenna 20. The coil antenna 20 is formed of a main body 26 in which a coil has been formed, harness terminals 12*a*, 12*b* implanted to the main body 26, and an exterior member 21 formed of nonconductive resin and covering the main body 26. The exterior member 21 is formed in a tube shape in which one end is opened and the other end is closed, and has a function of protecting the coil, etc. that are formed in the main body 26. The harness terminals 12*a*, 12*b* used for connection to external terminals are implanted to one end of the main body 26. On each of the upper and lower surfaces of the exterior member 21, an eddy-current generation member 29 (for example, a metal tape member) that generates an eddy current on its surface by the occurrence of a magnetic field and a magnetic flux is formed. The eddy-current generation member 29 is in a rectangular shape in substantially the same size relative to the upper and lower surfaces of the exterior member 21.

FIG. 5B is a perspective view illustrating an example that the exterior member 21 has been detached from the coil antenna 20. The exterior member 21 is a housing in a rectangular parallelepiped shape having a cross section in a hollow shape that is substantially the same as the shape of the cross section in the width direction of the main body 26. Then, the eddy-current generation member 29 is formed on each of the upper and lower surfaces of the exterior member 21. The main body 26 includes a base 14 formed of nonconductive resin, and a coil winding section 25 on which a coil 25*a* has been formed through an insulating layer. The coil 25*a* is formed by winding a conductive wire (coil wire) a desired number of turns around an insulating layer 13 that is an insulating tube of a rubber family. The insulating layer 13 covers a magnetic core 18 that is a flat plate in the shape of a rod (see FIG. 5C described later), and provides isolation between the wound conductive wire and the magnetic core 18.

The base 14 is formed with a concave portion for mounting a condenser 17, and this concave portion serves as a condenser mounting section 14*c*. In the base 14, grooves 14*a*, 14*b* that guide the conductive wire not to contact the exterior member 21 are formed. One end of the coil 25*a* is guided along the groove 14*b* and is twined around the harness terminal 12*a*. The other end of the coil 25*a* is guided along the groove 14*a* and is connected to a terminal electrode in the condenser mounting section 14*c*. The condenser 17 is mounted in the condenser mounting section 14*c*, and one electrode of the condenser 17 is connected to a terminal electrode of the harness terminal 12*b*. The other electrode of the condenser 17 is connected to the other end of the coil 25*a*. Thus, the condenser 17 and the coil 25*a* are connected in series and thereby a series resonant circuit is constituted.

FIG. 5C is a perspective view illustrating an example of a state that the main body 26 has been disassembled. The coil winding section 15 is formed by inserting the magnetic core 18 made of a ferrite material into the insulating layer 13 that is an insulating tube of a rubber family. The magnetic core 18 uses as the material a ferrite of an Mn—Zn family that is superior in the magnetic characteristic such as the magnetic permeability, the maximum saturation magnetic flux density, etc. so that a strong magnetic field can be excited, and is in a flat plate shape. By covering the magnetic core 18 with the insulating layer 18, short-circuiting that could occur between the conductive wire and the magnetic core 18 can be suppressed. Also, when winding the conductive wire around the coil winding section 15, it is possible to suppress a trouble such that the covering film of the conductive wire is peeled off at a corner portion of the magnetic core 18. And, by insulating the conductive wire (coil wire) that is wound around the coil winding section 25 with the exterior member 21, short-circuiting that could occur between the conductive wire and the eddy-current generation member 29 (for example, a metal tape member) can be suppressed.

Note that the material of the magnetic core 18 is not limited to the ferrite of an Mn—Zn family, and a ferrite of an Ni—Zn family, a magnetic body of a metal family, etc. having a desired magnetic characteristic may be adopted as the material. Further, the magnetic core 18 has been assumed to be a flat plate in the shape of a rod, however, may be in an arbitrary shape depending on the use.

Here, the material of and the method of forming a thin film of the eddy-current generation member 29 used in the coil antenna 20, and the band-pass characteristics when the material and the formation place of the eddy-current generation member 29 have been changed are similar to those of the case of the eddy-current generation member 19 of the coil antenna 10 according to the first embodiment previously described, so that the detailed description is omitted.

The coil antenna 20 described above differs from the first embodiment in that the eddy-current generation member 29 has been formed in the exterior member 21. However, the coil antenna 20 acts in a similar manner to the coil antenna 10 and produces similar effects. Further, because the eddy-current generation member 29 is formed on the exterior member 21, adjustment of the Q value can be performed more easily while confirming the band-pass characteristic. Thus, there is an effect that a fine adjustment for making the Q value to a desired value becomes easy.

Note that although a metal tape member has been adopted as the eddy-current generation member 29 that is formed in the coil antenna 20, as in the above-described first embodiment, a metallic thin film, a metal-plated film, a metal ribbon, a metal-coated film, etc., may be adopted.

Further, the eddy-current generation member 29 (metal tape member, metallic thin film, metal ribbon, etc.) that is formed in the coil antenna 20 has been attached to or formed in each of the wide surfaces, i.e., upper and lower surfaces of the exterior member 21 so as to cover the entire surface thereof. At this time, depending of the degree of adjusting the Q value, the shape of the eddy-current generation member can be variously changed.

Further, in the coil antenna 20, the eddy-current generation member 29 has been formed only in the wide surface (upper and lower surfaces or one surface) of the exterior member 21. And, if it is considered that forming the eddy-current generation member in the formation location of the coil or the place where the magnetic flux distribution and magnetic field distribution are strong is effective for adjustment of the Q value, the eddy-current generation member may be formed in any place. Here, description is made referring to FIG. 6, with respect to a configuration example when the eddy-current generation member is formed in the exterior member 21.

FIG. 6A illustrates an example that an eddy-current generation member 29*a* has been formed on each of the upper and lower surfaces of the exterior member 21. The size of the eddy-current generation member 29*a* is made a little bit smaller than those of the upper and lower surfaces of the exterior member 21. Of course, the eddy-current generation member 29*a* may be formed only in one of the upper and lower surfaces correspondingly to a desired Q value adjustment.

FIG. 6B illustrates an example that an eddy-current generation member 29*b* has been formed in each of the side surfaces of the exterior member 21. The size of the eddy-current generation member 29*b* is made a little bit smaller than those of the side surfaces of the exterior member 21. Of course, the eddy-current generation member 29*b* may be formed only in one of the side surfaces correspondingly to a desired Q value adjustment.

FIG. 6C illustrates a case that an eddy-current generation member 29*c* has been formed in an end surface on the closed-end side of the exterior member 21. The size of the eddy-current generation member 29*c* is made a little bit smaller than that of the end surface of the exterior member 21. In this case, most of the magnetic flux discharged from or absorbed by the end surface and the magnetic field passes the eddy-current generation member 29*c*. Consequently, it is possible to efficiently generate the eddy current, and the adjustment width of the Q value becomes large.

As illustrated in FIG. 6A through FIG. 6C, the eddy-current generation member can be formed in any place on the exterior member 21. Also, the size of the eddy-current generation member can be varied. Thus, because the eddy-current generation member can be formed in a desired place on the exterior member 21, there is an effect that the Q value can be finely adjusted. Also, because the eddy-current generation member can be easily formed, there is an effect in cost decrease. It is needless to say that it is possible to finely adjust the Q value by multiply combining the eddy-current generation members illustrated in FIG. 6A through FIG. 6C.

Figure 7:
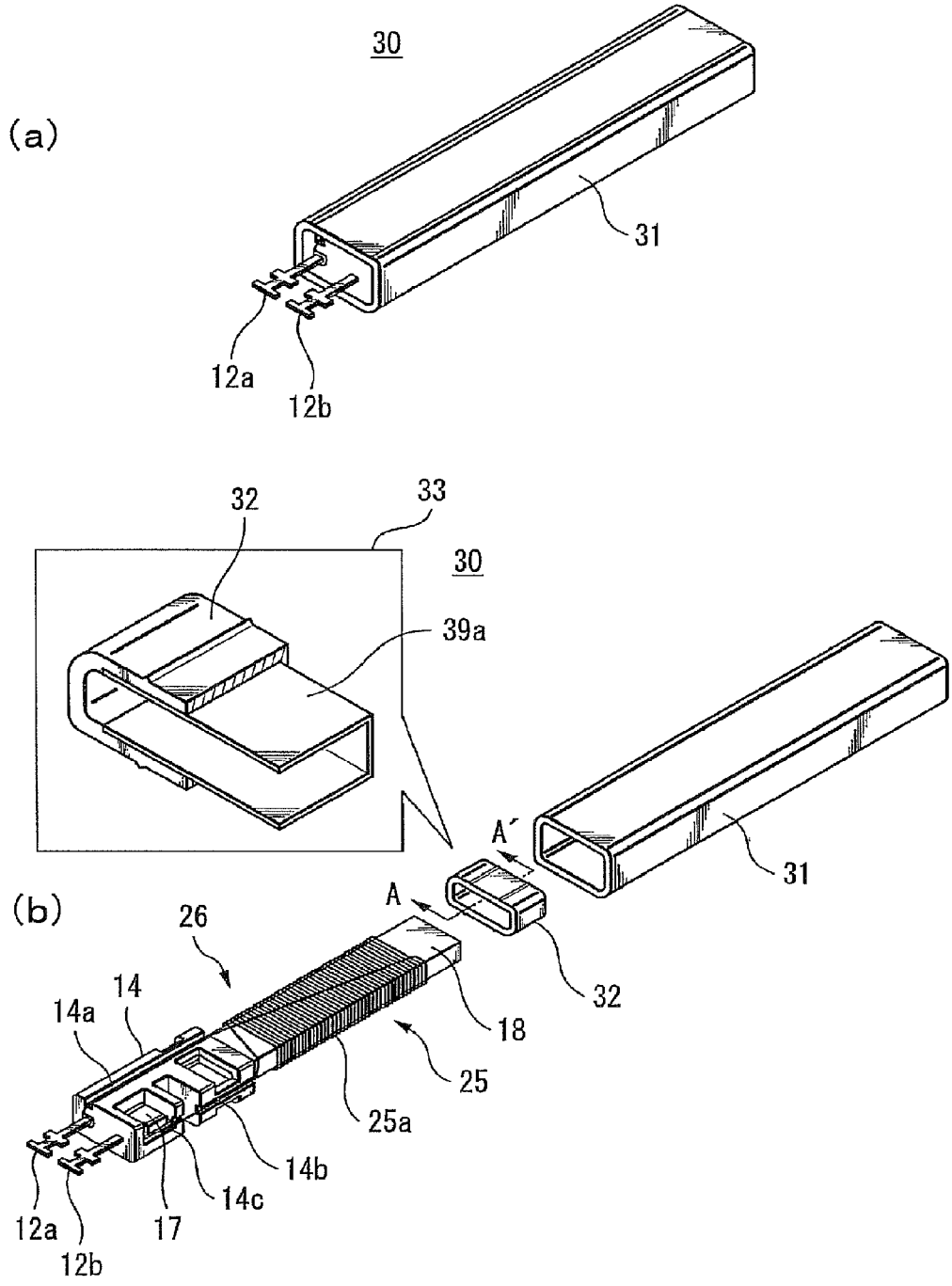
FIG. 7 is a perspective view illustrating a coil antenna in a third embodiment of the present invention.
Figure 8:
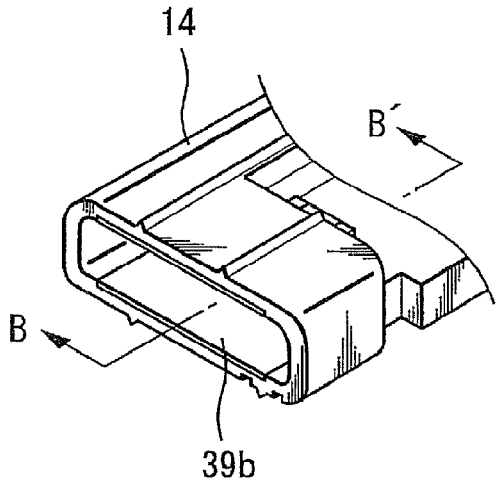
FIG. 8 is an enlarged perspective view illustrating a base in the third embodiment of the present invention.
Figure 8:
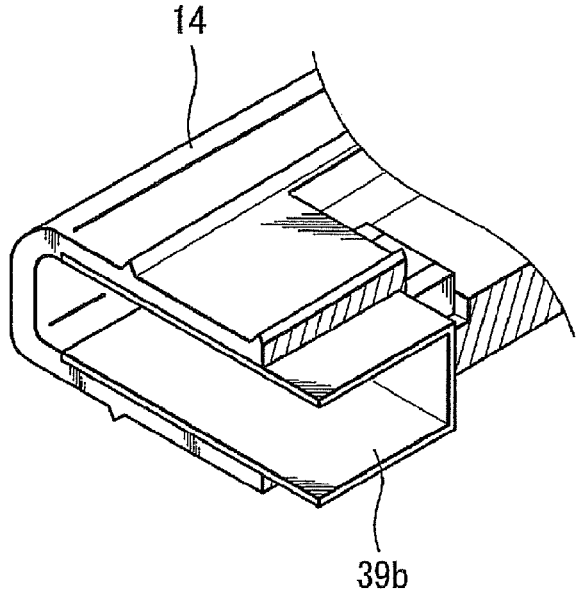

Next, description is made with respect to a configuration example of a coil antenna according to a third embodiment of the present invention, referring to FIG. 7 and FIG. 8. In this embodiment also, description is made as an example applied to a coil antenna 30 which will be adopted in a keyless entry system. Note that the coil component of the present invention that is constituted of a magnetic core and a wound coil is favorably applied to the coil antenna 30. The parts corresponding to those of FIG. 5 in the previously described second embodiment are denoted by the same reference symbols.

First, description is made referring to FIG. 7, with respect to a configuration example of the coil antenna 30. Note that the base 14, the coil winding section 25, and the main body of the coil antenna 30 are the same in configuration as respective parts of the coil antenna 20 already described, so that detailed description thereof is omitted.

Also, the material of an eddy-current generation member 39*a* that is used in the coil antenna 30 and the band-pass characteristic when the material and formation place of the eddy-current generation member 39*a* have been changed are similar to those of the eddy-current generation member 19 of the coil antenna 10 according to the first embodiment previously described, so that the detailed description is omitted.

FIG. 7A is a perspective view illustrating an example of the coil antenna 30. As illustrated in FIG. 7A, the coil antenna 30 according to the third embodiment differs from the coil antenna 20 already described in that the eddy-current generation member is not formed in an exterior member 31.

FIG. 7B is a perspective view illustrating an example of a state that the exterior member 21 has been detached from the coil antenna 30. As illustrated in FIG. 7B, in the coil antenna 30, a resin cap 32 made of resin is fit to the end of the main body 26 to which the base 14 is not attached. The resin cap 32 is a housing in a rectangular parallelepiped shape having a cross section in a hollow shape that is substantially the same as that of a transverse section in the width direction of the main body 26.

Here, description is made with respect to an example of a state that the resin cap 32 is transversely viewed at an A-A' line, referring to an enlarged area 33 which is an enlarged view of the resin cap 32. In the resin cap 32, an eddy-current generation member 39*a*, which is formed by bend-processing a plate member formed of a conductive metal material (for example, copper plate, aluminum plate, stainless plate) in a U-character shape, is disposed by insert molding. The insert molding is a molding method in which when producing the resin cap 32 by injection molding, molten resin is injected in a state that the eddy-current generation member 39*a* has been placed in advance in the mold cavity.

And, the coil antenna 30 is configured such that when accommodating the main body 26 (including the internal coil) in the exterior member 31, the exterior surfaces of the base 14 and the resin cap 32 touch the internal surface of the exterior member 31. Consequently, it becomes possible to securely position and hold the main body 26, relative to the exterior member 31.

The eddy-current generation member 39*a* constituting the coil antenna 30 described above is formed only by bend-processing a plate member made of a conductive metal material. Therefore, the manufacture of the eddy-current generation member 39*a* becomes easy. Further, because the eddy-current generation member 39*a* has a simple configuration and yet generates a large amount of eddy currents, there is an effect that the Q value can be efficiently adjusted.

The resin cap 32 disposed in the eddy-current generation member can be easily and securely held only by fitting it to the magnetic core 18. Consequently, there is an effect that the assembly process of the coil antenna 30 can be simplified. Also, the coil antenna 30 thus configured has an effect that the production cost can be suppressed low.

Note that the eddy-current generation member 39*a* can be formed in varieties of shapes. That is, by changing the thickness and area of the plate member, the occurrence degree of the eddy current can be adjusted. Also, the eddy-current generation member 39*a* illustrated in FIG. 7 is formed in a U-character shape. In other words, the eddy-current generation member 39*a* is formed so as to cover the three surfaces of the magnetic core 18. To perform a desired Q value adjustment, the eddy-current generation member may be formed in an L-character shape covering the two surfaces of the magnetic core 18.

Also, the eddy-current generation member may be disposed in a part of the base 14 into which the magnetic core 18 is inserted and which holds the magnetic core 18. Here, description is made referring to FIG. 8, with respect to a configuration example of an eddy-current generation member 39*b* disposed in the base 14.

FIG. 8A is a perspective view illustrating the base 14 viewed from the side that the coil winding section 25 is attached. The eddy-current generation member 39*b* is disposed inside the base 14.

FIG. 8B is a perspective view illustrating a state of the base 14 described with reference to FIG. 8A, transversely viewed at a line B-B'. In the base 14, the eddy-current generation member 39*b* that is formed by bend-processing a plate member formed of a conductive metal material (for example, copper plate, aluminum plate, stainless plate) in a U-character shape is disposed by insert molding.

To the above-described coil antenna 30, the eddy-current generation member adjusted to the adjustment condition (thickness, area, disposition position, etc.) can be attached after measuring the electrical characteristic (resonance frequency: $f_0$ and Q value) of the internal coil alone in advance (electrical characteristic is measured in a previous stage of attaching the exterior member). Therefore, there is an effect that design of the coil antenna 30 becomes easy.

The function and effects of the eddy-current generation member 39*b* are the same as those of the previously described eddy-current generation member 39*a*. Moreover, the resin cap 32 disposed in the eddy-current generation member is not limited to those fitted to the magnetic core 18, and even if the resin cap 32 is formed so as to be fitted to the exterior member 31, the same function and effects as those of the eddy-current generation member 39*a* are obtained. Further, the shape of the eddy-current generation member may be similar to that of the resin cap 32.

Figure 9:
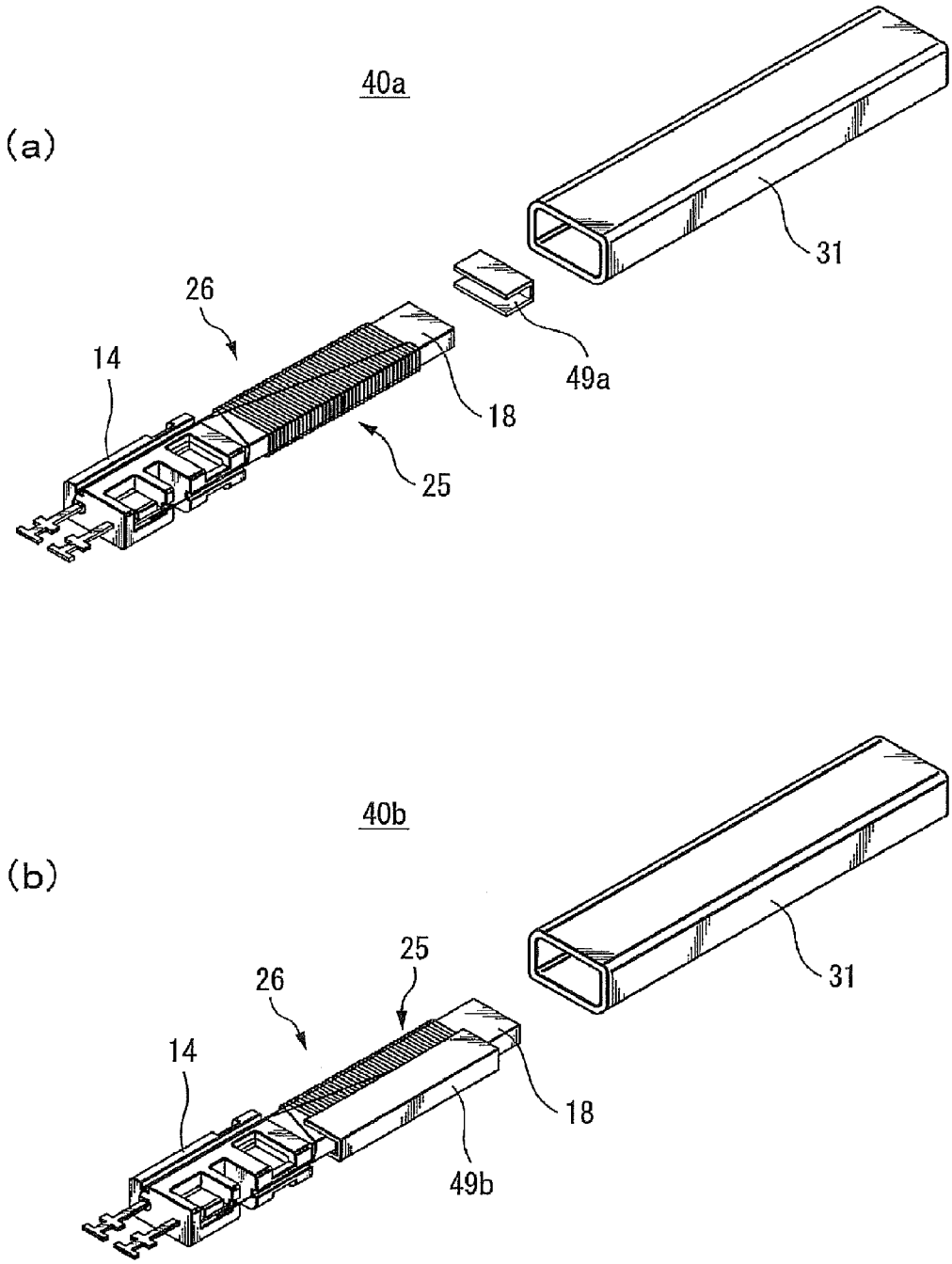
FIG. 9 is a perspective view illustrating a coil antenna in a fourth embodiment of the present invention.

Next, description is made referring to FIG. 9, with respect to a configuration example of a coil antenna according to a fourth embodiment of the present invention. In this embodiment also, description is made as examples applied to coil antennas 40*a*, 40*b*, which will be adopted in a keyless entry system. Note that the coil component of the present invention that is constituted of a magnetic core and a wound coil is favorably applied to the coil antennas 40*a*, 40*b*. The parts corresponding to those of FIG. 5 in the previously described second embodiment are denoted by the same reference symbols.

First, description is made referring to FIG. 9, with respect to a configuration example of the coil antennas 40*a*, 40*b*. Note that the base 14, the coil wining section 25, and the main body 26 of the coil antennas 40*a*, 40*b* are the same in configuration as respective parts of the coil antenna 20 already described, so that detailed description thereof is omitted.

Also, the band-pass characteristics when the material and the formation place of eddy-current generation members 49*a*, 49*b* that are used in the coil antennas 40*a*, 40*b* have been changed are similar to those of the eddy-current generation member 19 of the coil antenna 10 according to the first embodiment previously described, so that the detailed description is omitted.

FIG. 9*a* is a perspective view illustrating an example of a state that the exterior member 31 has been detached from the coil antenna 40*a*. In the coil antenna 40*a*, the conductive eddy-current generation member 49*a* formed in a U-character shape is fitted to the end of the coil winding section 25 in which the base 14 has not been attached and is fixed by adhesion.

In the present embodiment, only the eddy-current generation member 49*a* formed by forming a plate member made of a conductive metal material in a U-character shape is fitted to the magnetic core 18 and is fixed by adhesion. Here, if it is considered that a magnetic field is generated not only in the end surface of the magnetic core 18 but also in the vicinity of the part where the coil is wound, the eddy-current generation member 49*b* may be formed in an arrangement illustrated in FIG. 9B.

FIG. 9B is a perspective view illustrating an example of a state that the exterior member 31 has been detached from the coil antenna 40*b*. In the coil antenna 40*b*, the conductive eddy-current generation member 49*b* formed in a U-character shape is fitted to one side surface of the coil winding section 25 to which the base 14 is not attached and is fixed by adhesion. In this case, to surely prevent short-circuiting that could occur between the coil and the eddy-current generation member, it is preferable to set the insulating resin film of the wire used for the coil thicker, or in the eddy-current generation member, to form an insulating film or sheet in the surface contacting the coil.

When manufacturing the above-described coil antennas 40*a*, 40*b*, first, the electrical characteristic (for example, resonance frequency: $f_0$, Q value) of the internal coil alone is measured. This electric characteristic is measured in the previous stage of attaching the exterior member. Thereafter, in a state that thickness, area, disposition position, etc. have been adjusted as the conditions to be adjusted, the eddy-current generation members 49*a*, 49*b* are attached to the coil antennas 40*a*, 40*b*. It is possible to adjust the occurrence degree of the eddy current by changing the thickness and area of the plate member of the eddy-current generation members 49*a*, 49*b*. By passing through such process, improvement in the production efficiency including adjustment of the electrical characteristic can be expected, and there is an effect that designing while optimizing the electrical characteristic of the coil antennas 40*a*, 40*b* becomes easy.

Note that although each of the eddy-current generation members 49*a*, 49*b* has been fitted to the tip end portion of the magnetic core 18 and fixed by adhesion, each of the eddy-current generation members 49*a*, 49*b* may be arranged in the rear end portion (on the base side) of the magnetic core 18. Also, it is possible to arrange each of the eddy-current generation members 49*a*, 49*b*, when producing the exterior member 31 by injection molding, on the exterior member 31 side using the insert molding means.

Also, if the eddy-current generation member 49*b* is in a U-character shape, the eddy-current generation member 49*b* may be arranged so as to cover any direction of the coil. Also, the eddy-current generation member 49*b* may be bent in a square ring shape so as to cover the entire circumference of the coil, however, it is desirable to intervene an insulating layer between the coil and the eddy-current generation member to prevent electrical leakage from the coil.

Figure 10:
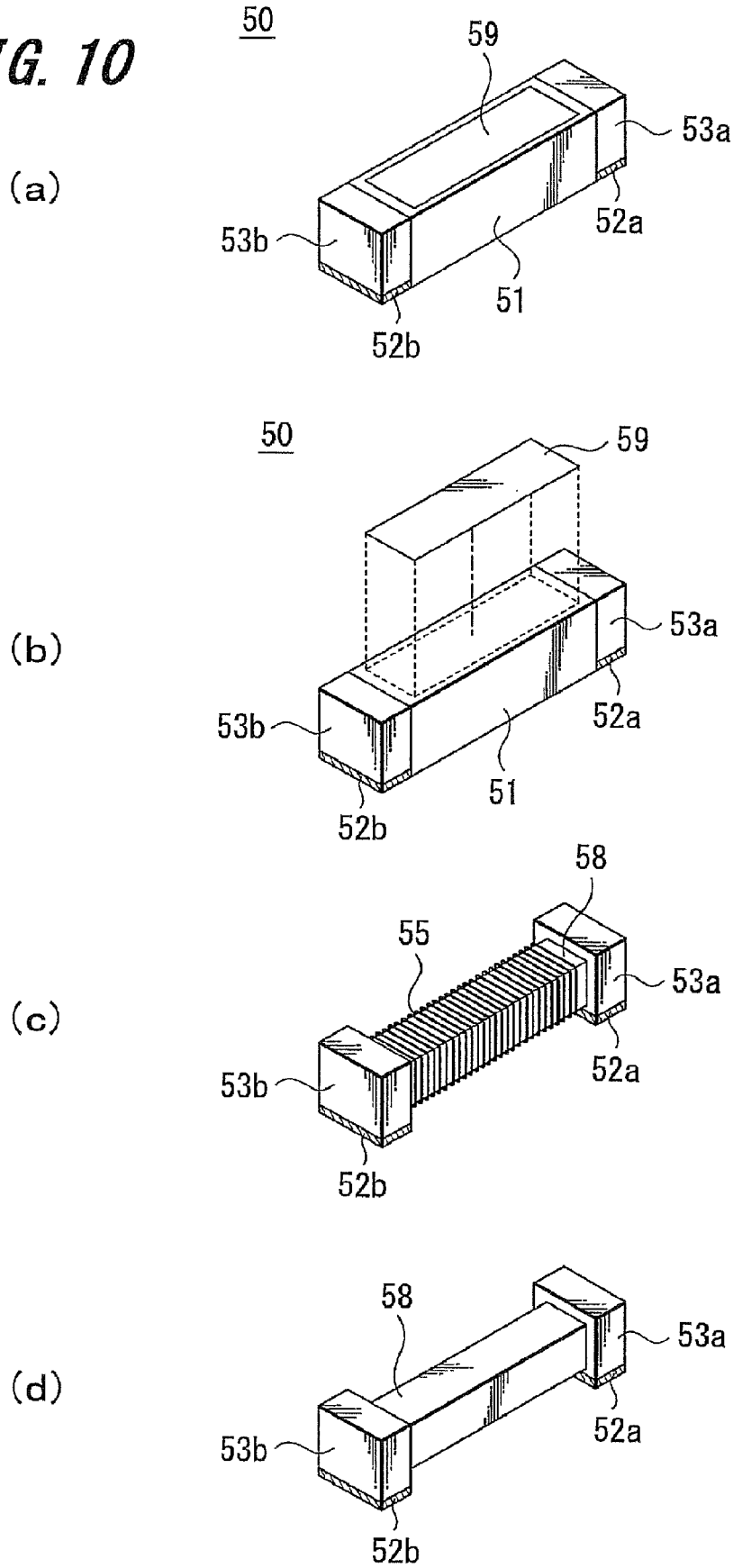
FIG. 10 is a perspective view illustrating a coil antenna in a fifth embodiment of the present invention.
Figure 11:
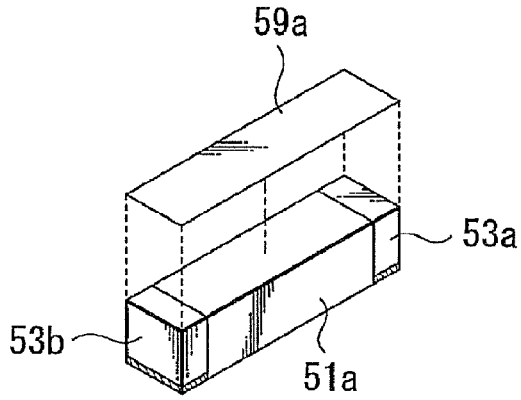
FIG. 11 is a perspective view illustrating examples of an eddy-current generation member formed in an exterior member in the fifth embodiment of the present invention.
Figure 11:
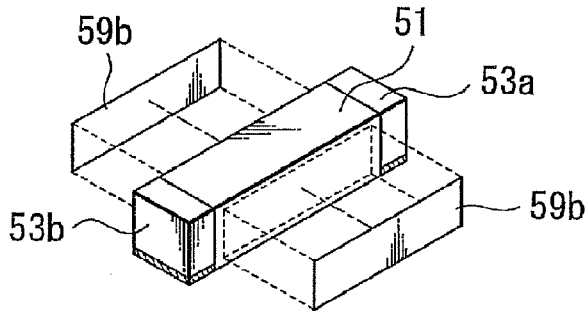
Figure 11:
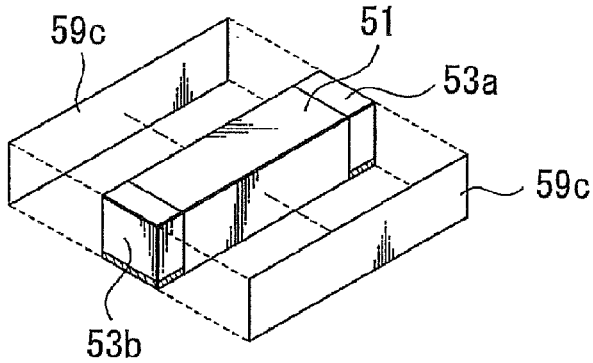
Figure 11:
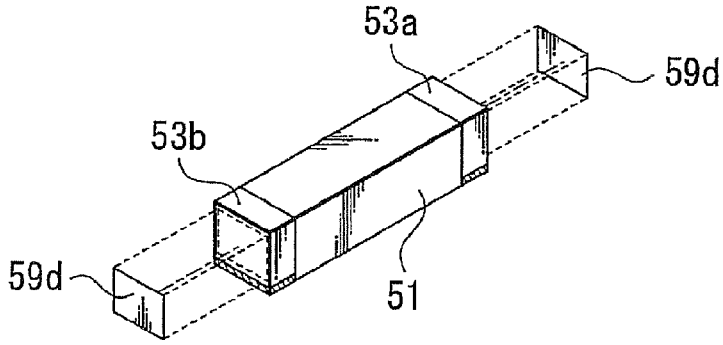
Figure 12:
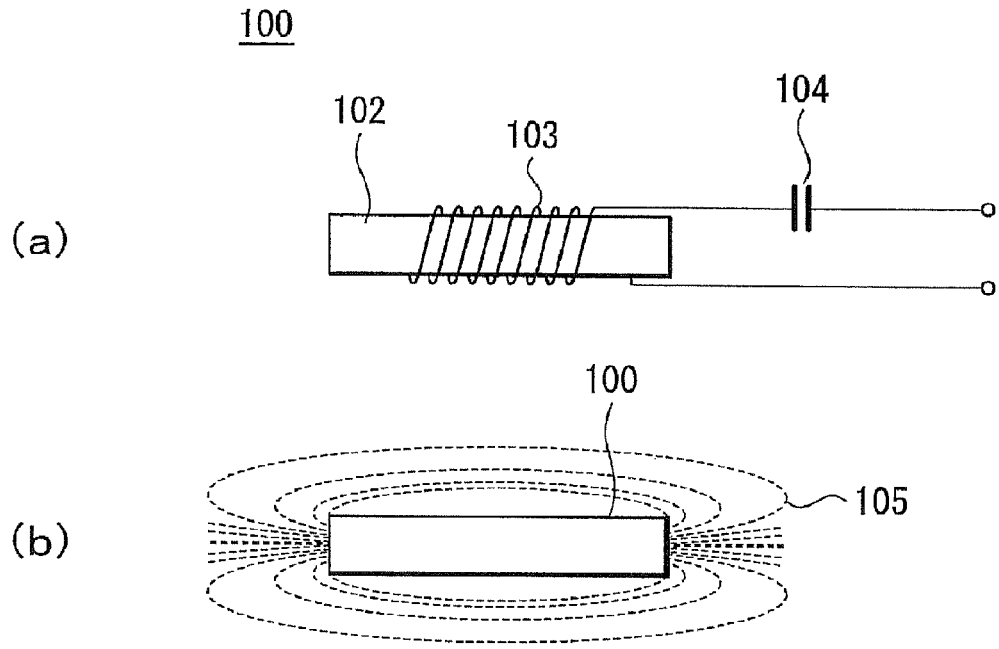
FIG. 12 is a configuration diagram illustrating an example of a conventional coil antenna.
Figure 13:
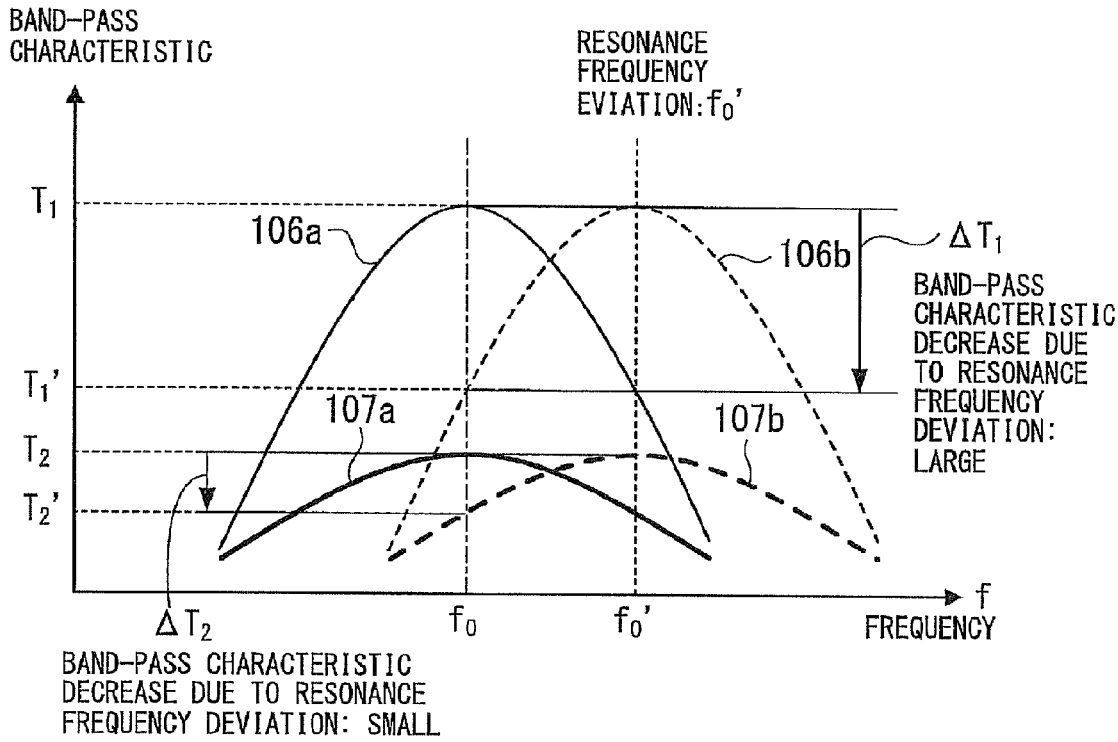
FIG. 13 is an explanatory diagram illustrating an example of a band-pass characteristic of a conventional coil antenna.

Next, description is made with respect to a configuration example of a coil antenna according to a fifth embodiment of the present invention, referring to FIG. 10 and FIG. 11. In this embodiment also, description is made as an example applied to a coil antennas 50, which will be adopted in a keyless entry system, a radio-controlled clock, etc. Note that the coil component of the present invention that is constituted of a magnetic core and a wound coil is favorably applied to the coil antennas 50.

First, description is made referring to FIG. 10, with respect to a configuration example of the coil antenna 50.

FIG. 10A is a perspective view of the coil antenna 50 mainly favorably used in radio-controlled clocks, etc. The coil antenna 50 of a so-called winding chip type is formed in a rectangular shape. On the upper surface of the coil antenna 50, an eddy-current generation member 59 (for example, metal tape member) that generates an eddy current on its surface by occurrence of a magnetic field or magnetic flux is formed. And, the coil antenna 50 is provided with flange portions 53*a*, 53*b* at both ends. Then, terminal electrodes 52*a*, 52*b* for connection to a substrate are formed in lower surfaces of the flange portions 53*a*, 53*b*. Then, an exterior member 51 formed of a nonconductive resin compact is formed so as to cover a coil 55 (see FIG. 100 described later).

FIG. 10B is a perspective view illustrating a state that the eddy-current generation member 59 has been detached from the coil antenna 50. The size of the eddy-current generation member is made a little bit smaller than the size of the upper surface of the exterior member 51. Note that the eddy-current generation member 59 may be arranged only in one of the upper and lower surfaces correspondingly to a desired Q value adjustment.

FIG. 10C is a perspective view illustrating a state that the exterior member 51 has been detached from the coil antenna 50. The coil 55 is formed by winding a conductive wire (coil wire) a desired number of turns around the magnetic core 18 whose material is ferrite. Both ends of the conductive wire are connected to the terminal electrodes 52*a*, 52*b*, respectively.

FIG. 10D is a perspective view of a state that the conductive wire has been removed from the coil 55. A magnetic core 58, which is a drum-type core in a rectangular shape, is formed as a core portion of the coil 55.

The material and formation method of a thin film of the eddy-current generation member 59 that is used in the coil antenna 50, and the band-pass characteristic when the material and formation place of the eddy-current generation member 59 have been changed are similar to those of the eddy-current generation member 19 of the coil antenna 10 according to the first embodiment previously described, so that the detailed description is omitted.

The above-described coil antenna 50 differs from the first embodiment in that the eddy-current generation member 59 has been formed on the exterior member 51 formed in a rectangular shape, however, the coil antenna 50 operates in a similar manner to the coil antenna 10 and produces similar effects. In addition, because the eddy-current generation member 59 is formed on the exterior member 51, adjustment of the Q value can be more easily performed. At this time, while confirming the band-pass characteristic, the eddy-current generation member 59 is adjusted. Consequently, there is an effect that a fine adjustment for making the Q value to a desired value becomes easy.

Note that as the eddy-current generation member 59 that is formed in the coil antenna 50, a metal tape member has been adopted, however, as in the above-described first embodiment, various changes can be possible.

Also, in the above-described fifth embodiment, the eddy-current generation member 59 (metal tape member, metallic thin film, metal ribbon, etc.) that is formed in the coil antenna 50 has been attached to or formed in the upper surface of the exterior member 51. Note that depending on the degree of adjustment of the Q value, the shape of the eddy-current generation member may be variously changed.

As the coil antenna 50, an example has been described in which the eddy-current generation member 59 is formed only in the upper surface of the exterior member 51. Note that if it is considered that forming the eddy-current generation member in the coil formation position and the place where the magnetic flux or magnetic field distribution is strong is effective, the place where the eddy-current generation member is formed can be any place.

Here, description is made referring to FIG. 11, with respect to configuration examples that the eddy-current generation member has been formed in the exterior member 51.

FIG. 11A illustrates an example that an eddy-current generation member 59*a* has been formed over the upper surface of the exterior member 51 and the upper surfaces of flange portions 53*a*, 53*b* of a drum-type core in a rectangular shape. The eddy-current generation member 59*a* is in a rectangular shape having substantially the same size relative to the upper surfaces of the exterior member 51 and flange portions 53*a*, 53*b*. Of course, the eddy-current generation member 59*a* may be disposed in the lower surface or in each of the upper and lower surfaces of the exterior member 51, correspondingly to a desired Q value adjustment.

FIG. 11B illustrates an example that an eddy-current generation member 59*b* has been formed in each of the side surfaces of the exterior member 51. The size of the eddy-current generation member 59*b* is made a little bit smaller than the size of the side surface of the exterior member 51. Of course, the eddy-current generation member 59*b* may be disposed only in either of the side surfaces correspondingly to a desired Q value adjustment.

FIG. 11C illustrates an example that an eddy-current generation member 59*c* has been formed through each of the side surfaces of the exterior member 51 and flange portions 53*a*, 53*b* of a drum-type core in a rectangular shape. The eddy-current generation member 59*c* is in a rectangular shape having substantially the same size as that of the side surfaces of the exterior member 51 and flange portions 53*a*, 53*b*. Of course, the eddy-current generation member 59*c* may be arranged only in one of the two side surfaces correspondingly to a desired Q value adjustment.

FIG. 11D illustrates an example that an eddy-current generation member 59*d* has been formed in each of the end surfaces of the flange portions 53*a*, 53*b* of a drum-type core. The size of the eddy-current generation member 59*d* is made a little bit smaller than the size of the end surface of the exterior member 51. If the eddy-current generation member is formed in such manner, most of the magnetic flux discharged from or absorbed by the end surface or magnetic field passes the eddy-current generation member 59*d*. Consequently, it is possible to efficiently generate the eddy current, and the Q value adjustment width is increased.

As illustrated in FIG. 11A through FIG. 11D, the place where the eddy-current generation member is formed may be any place on the exterior member 51. Also, the size of the eddy-current generation member can be variously changed. Thus, because the eddy-current generation member can be formed in a desired place on the exterior member 51, there is an effect that the Q value can be finely adjusted. Also, because the eddy-current generation member can be easily formed, there is an effect in cost decrease also. Note that it is needless to say that the Q value can be finely adjusted by multiply combining the eddy-current generations members illustrated in FIG. 11A through FIG. 11D.

In the coil antennas according to the above-described first through fifth embodiments, by aggressively using the eddy current, the function similar to that of the conventionally connected series resistance is obtained. By applying the coil component according to the present invention to a coil antenna, the band-pass characteristic that is stable in a broad-band can be ensured. For the eddy-current generation member, any of a tape member using a conductive metallic foil, a thin film using a conductive metal material, a thin ribbon using a conductive metal material, a coated film using a conductive metal material, and a plate member using a conductive metal material may be selected or combined to be used.

Also, by using the eddy-current generation member, without increasing the direct current resistance of the entire coil antenna system adopting the coil antenna according to the first through fifth embodiments, the band-pass characteristic can be "loosened" by the generated eddy current. That is, there is an effect that the change width of the band-pass characteristic of the coil component can be suppressed. Also, because the eddy-current generation member can be easily formed, there is an effect that the production cost can be reduced. Also, because the direct current resistance that is connected to the conventionally used coil antenna becomes unnecessary, there is an effect that downsizing and unitization of the coil antenna system as a whole can be easily realized.

Also, as described above, it becomes possible to increase the communication speed of transmitting and receiving signals by adjusting the Q values by addition of the eddy-current generation member and thereby "loosening" the band-pass characteristic. As a result, it becomes possible to perform accurate communication of ID information in the keyless entry system, resulting in realizing improvement in the security level.

Further, the coil antenna in which the coil component according to the present invention has been applied aggressively uses the phenomenon that a part or the whole of a magnetic field excited by an eddy-current generation member is converted as an eddy-current loss. Therefore, the Q value can be easily adjusted to a desired value. Accordingly, it becomes unnecessary to externally connect a resistance element to the coil antenna, so that it becomes possible to attain decreasing the number of components and decreasing the direct current resistance value in a coil antenna system. Also, because the eddy-current generation member is provided so as to contact the magnetic core, it becomes possible to efficiently convert the magnetic flux and magnetic flux as the eddy current and adjust the Q value. Also, when using a metallic thin film, a metal ribbon, a metal-plated film, a metal-coated film, a plate member, etc. as the material of the eddy-current generation member, the thickness thereof can be appropriately increased and decreased in the allowable range of the design condition of the coil antenna. By increasing and decreasing the thickness, it is possible to increase and decrease the adjustment range of the Q value.

Note that in the first through fifth embodiments of the present invention, description has been made with respect to the eddy-current generation members each in a rectangular shape, however, the shape of the eddy-current generation member is not limited to the rectangular shape. The eddy-current generation member may be configured so as to contact the exterior member or to contact the exterior member and the magnetic core. Also, the eddy-current generation member may be formed so as to cover two or more surfaces of the magnetic core and/or exterior member. Also, the eddy-current generation member can be in any shape as long as the eddy current can be generated in a concentrated manner in the coil formation position and the place where the magnetic flux and magnetic field distribution is strong.

Specifying the resonance frequency of a coil antenna is performed by applying an alternating electric current while changing the frequency in a specific frequency band including at least the resonance frequency and discriminating as a resonance point the frequency when the amount of the electric current value becomes maximum.

At this time, as in the first embodiment of the present invention, if it is tried to specify the resonance frequency after forming the eddy-current generation member in the coil antenna (after adjusting the Q value and loosening the band-pass characteristic), the change amount of the above-described electric current value becomes small, so that there is a problem that it becomes difficult to specify the resonance frequency by visual confirmation of the worker.

However, the first through fourth embodiments of the present invention adopt the configuration that the eddy-current generation member is formed after forming the internal coil alone. From this, by adopting such means to adjust the resonance frequency of the internal coil alone after considering the change component: $\Delta f$ of the resonance frequency that occurs when the eddy-current generation member has been added and to then form the eddy-current generation member, they have an advantage that the coil antenna having a correct resonance frequency can be efficiently produced.

Also, the eddy-current generation member is formed by selecting or combining any of a tape member using a conductive metallic foil, a thin film formed of a conductive metal material, a thin ribbon formed of a conductive metal material, a coated film using a conductive metal material, and a plate member using a conductive metal material. Consequently, depending on the usage condition and the production condition, the material of the eddy-current generation member can be freely selected, and there is an effect that the freedom in design is improved.

Also, the coil antenna according to the above-described embodiments has been applied to keyless entry systems and radio clocks, however, it is needless to say that even when the coil antenna is used as the coil component for other usages, similar functions and effects can be obtained.

EXPLANATION OF REFERENCE SYMBOLS

10 . . . coil antenna, 11 . . . exterior member, 12*a*, 12*b* . . . harness terminals, 13 . . . insulating layer, 14 . . . base, 14*a*, 14*b* . . . grooved portions, 15 . . . coil winding section, 15*a*-15*c* . . . coil, 16 . . . main body, 17 . . . condenser, 18 . . . magnetic core, 19*a*-19*c* . . . eddy-current generation member, 20 . . . coil antenna, 21 . . . exterior member, 25 . . . coil winding section, 25*a* . . . coil, 26 . . . main body, 29*a*-29*c* . . . eddy-current generation member, 30 . . . coil antenna, 39*a*, 39*b*, eddy-current generation member, 40 . . . coil antenna, 49*a*, 49*b* . . . eddy-current generation member, 50 . . . coil antenna, 51 . . . exterior member, 52*a*, 52*b* . . . terminal electrode, 53*a*, 53*b* . . . flange portion, 55 . . . coil, 58 . . . magnetic core, 59, 59*a*-59*d* . . . eddy-current generation member

The invention claimed is:

1. A coil antenna component comprising:

a straight rod shaped magnetic core;

a coil wound around the magnetic core;

an exterior member; and an eddy-current generation member;

wherein the exterior member is formed of nonconductive resin and covers the magnetic core and the coil, and wherein the eddy-current generation member is formed partially covering the straight rod such that at least a portion of the magnetic core is not covered by the eddy-current generation member, the eddy-current generation member being further formed so as to contact the exterior member or the magnetic core.

2. The coil antenna component according to claim 1, wherein the eddy-current generation member selectively uses any one of or any combination of a tape member using a conductive metallic foil, a thin film using a conductive metal material, a ribbon using a conductive metal material, a coated film using a conductive metal material, and a plate member using a conductive metal material.

3. The coil antenna component according to claim 2, wherein the eddy-current generation member is formed so as to cover at least two surfaces of the magnetic core and/or the exterior member.

4. The coil antenna component according to claim 1, wherein the eddy-current generation member comprises a coated film using a conductive metal material applied to the surface of the magnetic core.

* * * * *